United States Patent [19]

Ebejer

[11] 4,033,431

[45] July 5, 1977

[54] ACOUSTIC CROSSOVER SPEAKER ENCLOSURE

[76] Inventor: James G. Ebejer, 4951 Bantry, West Bloomfield, Mich. 48033

[22] Filed: Nov. 19, 1975

[21] Appl. No.: 633,371

[52] U.S. Cl. ..... 181/152; 181/182; 181/191

[51] Int. Cl.[2] ..... G10K 9/14; G10K 11/10

[58] Field of Search ..... 181/148–156, 181/177–195

[56] References Cited

UNITED STATES PATENTS

| | | | |
|---|---|---|---|
| 1,689,009 | 10/1928 | Byrns | 181/180 X |
| 2,205,804 | 6/1940 | Wells | 181/155 |
| 2,390,834 | 12/1945 | Hegener | 181/159 |
| 2,815,087 | 12/1957 | Delort | 181/152 |

*Primary Examiner*—Lawrence R. Franklin

*Attorney, Agent, or Firm*—Andrew R. Basile

[57] ABSTRACT

An acoustic crossover speaker enclosure comprising a multi-sided box having an apertured baffle supporting a horn which in conjunction with the interior of the box defines an air chamber. The horn is supported in an upright position such that the throat of the horn opens at the baffle end of the box where the front end of a driver projects into the horn throat, while the back side of the driver projects into the air chamber of the box. The horn opens at the top end of the box wherein sound waves emitted from the mouth of the horn are laterally reflected by means of a sound deflector panel. The air chamber transmits sound from the rearward side of the driver to a bass reflex port in one wall of the box such that a sound radiated from the rear of the driver may be added to the sound emitted from the front of the driver.

2 Claims, 3 Drawing Figures

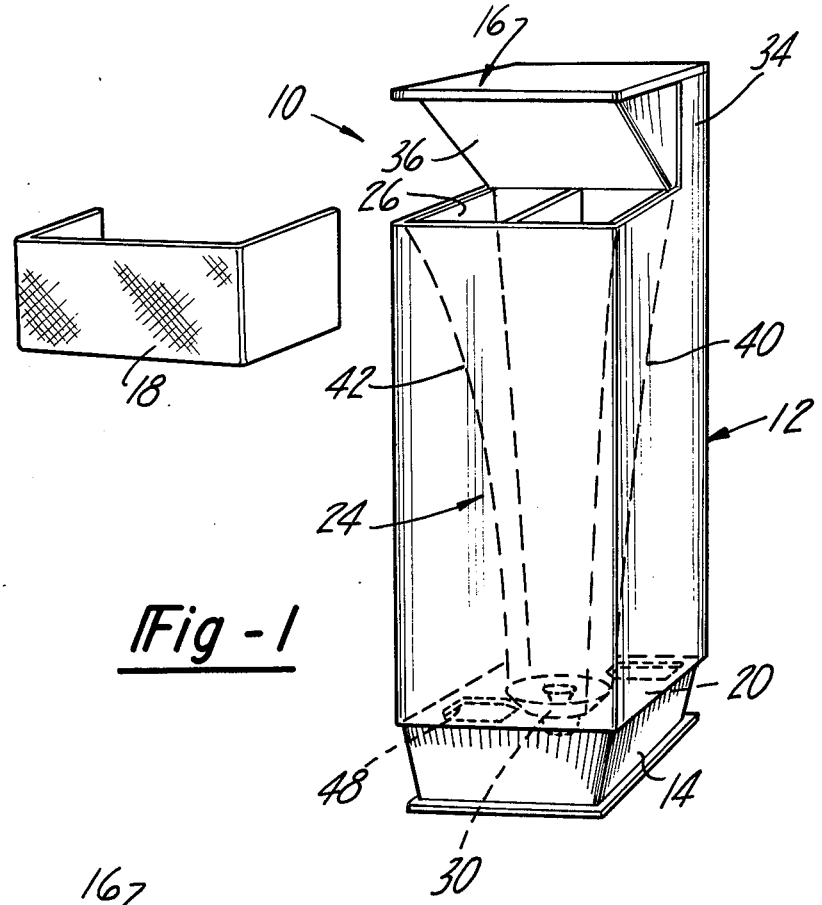
Fig-1
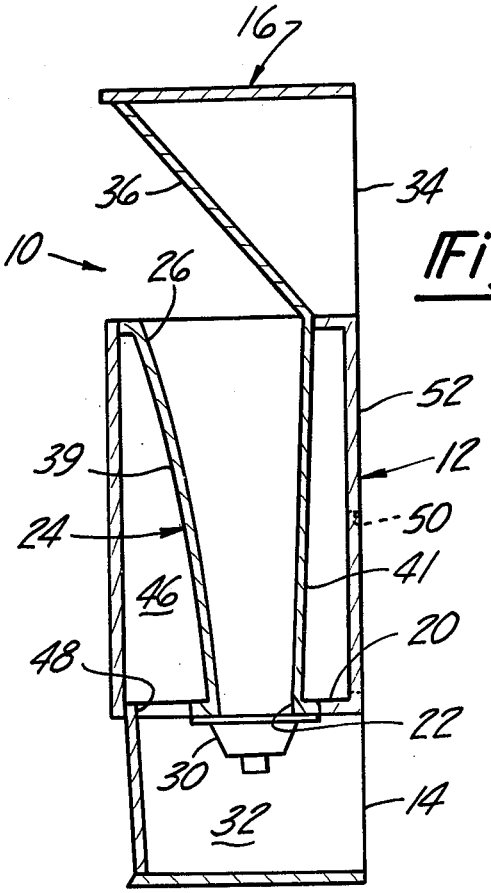
Fig-2
Fig-3
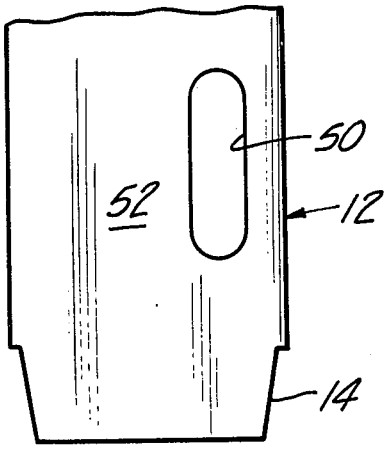

ACOUSTIC CROSSOVER SPEAKER ENCLOSURE

BACKGROUND OF THE INVENTION

I. Field of the Invention

The present invention relates to speaker enclosures and, in particular, the present invention relates to an improved speaker enclosure having an upright horn designed to amplify the efficiency of a wide-range driver mounted at the throat of the horn such that the sound emitted from the rear of the driver may be added to the sound emitted from the front of the driver.

II. Description of the Prior Art

In the prior art it has been recognized that in order to construct a speaker enclosure two factors must be considered in conjunction with each other; first, the speaker or driver and, secondly, the baffle or house in which the driver is mounted. In the design and construction of a speaker enclosure, the speaker may first be chosen to determine the type of enclosure to be constructed or the choice of enclosures desired may be used to dictate the required parameters of the speaker. Obviously, when decor, size, and limited available placements in a room are the ruling factor, good techniques consist of selecting the enclosure and matching the optimum speaker with the selected enclosure. If performance is the main objective, the speaker is first chosen and the disclosure is designed to provide a maximum utilization of the potential inherent in the selected driver.

A speaker by itself causes interference with its own output, and this is primarily due to the fact that the surface which moves the air (called the diaphragm or cone) causes the air to move in both the front and back of the surface. Thus, the diaphragm or cone generates simultaneous impulses which, unfortunately, are out of phase with one another. This means that, if the impulses are allowed to meet, they will cancel each other. Therefore, it has been a primary purpose of the prior art structures to separate the front of the diaphragm or cone from the back of the diaphragm or cone. If this is not accomplished, a large percentage of the energy fed into the speaker will be wasted in the fight between the air moved on either side of the diaphragm or cone surfaces.

Of the four basic forms in which a separation can be obtained, the finite baffle is the most commonly encountered in the furniture-type consoles and generally consists of a board of approximately 2-square feet with the speaker mounted in the center. This board forces the back radiation from the diaphragm or cone to travel along a path to reach the other side.

The infinite baffle type of construction is a second approach in use and, in theory, assumes that a speaker mounted on a board of infinite length and width will prevent the back radiation from ever meeting the front radiation, and no cancellation may take place. Thus, the only determining factor would be the ability of the speaker to move enough air at very low frequencies to allow it to be audible. Generally, the infinite baffle is constructed by mounting a speaker on a wall so that the front of the diaphragm or cone is in an entirely different room than the rear.

Another approach which has been devised is the bass-reflex enclosure which functions to add the radiation from the rear of the diaphragm or cone to the radiation emitted from the front of the diaphragm or cone. This is generally accomplished by using the volume of air in the enclosure which acts in conjunction with the mass of air entrapped in a tuned port to create an in-phase, additive relationship. This combination of the rear radiation being added in phase to the radiation off the front of the cone results in almost twice the output from any given excursion of the cone that would be expected if the speaker were mounted in an infinite baffle.

The fourth type of projector is known as a horn projector wherein the bass response is substantially increased if the front of the cone is coupled to a long expanding cone. In most types of horns the effect is to present to the small diaphragm at the throat a very high, but consistent, acoustical impedance while transforming the high-pressure, low particle-velocity wave from the surface of the cone into a low-pressure, high particle-velocity wave with a low impedance, matching that of the air in the room as it reaches the mouth of the horn.

Examples of prior art structures known to the inventor include the inventions disclosed in U.S. Pat. Nos. 1,597,611; 1,692,994; 1,760,892; 2,670,053; 2,847,081; 2,955,669; and 3,554,314. While each of these patents disclose apparatus for overcoming certain disadvantages inherent with the prior art apparatuses in an effort to achieve an excellent dispersion and presentation of sound at seating level by means of an inexpensive enclosure and driver arrangement, none disclose an invention of the type which applicant claims herein.

SUMMARY OF THE INVENTION

The present invention, which will be described subsequently in greater detail, comprises an acoustical crossover speaker enclosure comprising a box having an apertured baffle which centrally mounts an extended range driver such that the front of the driver projects into the throat of an upright positioned horn, while sound waves emitted from the mouth of the horn are laterally deflected by an inclined deflection plate, such that the sound is dispersed and presented at seating listening level. At the same time sound waves emitted from the back side of the driver are transmitted through an air chamber (defined by the interior walls of the box and the exterior walls of the horn) and a bass-reflex port in one of the walls of the box.

It is therefore an object of the present invention to provide a new and improved acoustic crossover speaker enclosure designed to amplify the efficiency of an extended range driver such that the complete audio spectrum thereof is reinforced.

It is a further object of the invention to employ an upright horn having tapered side surfaces to discourage or dampen overtones created by the box to reduce the need for excessive sound-absorbing materials in the enclosure and, thus, increase the bass response and efficiency of the driver.

It is still another object of the present invention to provide an acoustic crossover speaker enclosure which is simple in design and construction and, thus, inexpensive to manufacture.

Other objects, advantages, and applications of the present invention will become apparent to those skillwd in the art of acoustic crossover speaker enclosures when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and in which:

FIG. 1 is a partially exploded perspective view of one example of the present invention in the form of an acoustical crossover loudspeaker enclosure;

FIG. 2 is a longitudinal sectional view through the acoustic crossover speaker enclosure illustrated in FIG. 1 of the drawing; and FIG. 3 is a fragmentary rear elevational view of the acoustic crossover speaker enclosure illustrated in FIGS. 1 and 2 of the drawing.

DESCRIPTION OF THE PREFERRED EMBODIMENT

Referring now to the drawing and, in particular, FIG. 1 wherein there is illustrated one example of the present invention in the form of an acoustic crossover. speaker enclosure 10 which comprises a multi-sided cabinet or box 12 mounted on a pedestal 14 and including a deflection panel assembly 16 and a grill frame 18 at the top thereof.

At the inner face between the cabinet 12 and the pedestal 14, the pedestal 14 supports an apertured baffle panel 20 which, in turn, supports the lower end or throat 22 of an uprightly disposed horn 24, the mouth 26 of which opens at the top of the cabinet 12, all of which will be described in greater detail hereinafter.

The baffle panel 20 further supports an extended range driver 30 that is mounted such that the front cone surface of the driver 30 projects into the throat 22 of the horn 24, while the back side of the driver cone is disposed within an air chamber 32 defined by the interior walls of the pedestal 14 and the back side of the apertured baffle panel 20.

As aforementioned, the upper end of the cabinet 12 supports a deflection panel assembly 16 which comprises an outer support structure 34, attached to the upper end of the cabinet 12 by any suitable means, and a deflction panel 36, carried by the support structure 34. As can best be seen in FIGS. 1 and 2, as sound is emitted from the horn mouth 26, the sound will be laterally deflected by the deflction panel 36 into the listening area. This arrangement provides an excellent dispersion and presentation of sound at the seating listening level.

The grill frame 18 may be fabricated from any suitable components and has a conventional fabric on the outside thereof. The grill frame 18 is so sized as to be complementarily received by the deflection panel assembly 16 and the upper edges of the cabinet 12 and secured thereto by any suitable fastening means.

The horn 24 having a rectangular cross-section, may be tapered on its front wall 39, its rear wall 41, and its side walls 40 and 42, while its throat 22 is attached to the face of the extended range driver 30 and functions to amplify the upper bass, mid-range and treble generated by the driver 30. While the front wall 39 is illustrated as being tapered, a combination of front, rear, or side walls may also be tapered. The shape may be as desired; such as conical, hyperbolic, parabolic, or exponential.

The outer walls of the horn 24 and the interior walls of the cabinet 12 define a second air chamber 46 which functions to communicate the sound waves reflected from the rear side of the driver 30 through the air chamber 32, apertures 48 in the apertured baffle panel 20, and the air chamber 46 to a bass reflex-opening 50 located on the back wall 52 of the cabinet walls.

The combination of tapering the four sides of the horn 24 and extending the horn for the full length of the cabinet 12 has the effect of discouraging or dampening the development of overtones created by the cabinet 12, and those that do develop are more readily broken up. Thus, a simple means is provided for utilizing the energy generated by the back radiation from the cone speaker.

It should be noted that, while the interior of the cabinet 12 has been referred to as two air chambers 32 and 46, there is actually only one air chamber which would be more apparent if the horn 24 were supported by a spider-type bracket rather than the baffle panel 20. It should also be noted that the housing could be of a circular shape.

As aforementioned, if the cone is not baffled, the back radiation interferes with the front radiation, that is, the sound emitted through the horn 24. If infinite baffles are provided to insure that the back radiation never meets the front radiation in this detrimental manner, then the back radiation may not be usefully added to the output of the front radiation generated by the horn and driver combination.

Actual experimentation by the inventor utilizing an eight-inch extended range driver has resulted in an output that reinforces the complete audio spectrum rather than just the bass response only, as is typical with conventional bass reflex ported systems. Applicant's invention is designed to amplify the efficiency of an extended wide-range driver mounted in the throat of the horn to provide quality and performance without the need for having to utilize high-performance and high-quality components, and thus a quality system may be provided with a minimum expenditure of funds.

It should be understood by those skilled in the art of acoustic crossover speaker enclosures that other forms of the present invention can be had, all coming within the spirit of the invention and the scope of the appended claims.

What is claimed is as follows:

1. A speaker enclosure comprising:

an enclosed cabinet disposed in an upright position having an opening at the top end;

a horn disposed in an upright position within said cabinet, said horn having a throat opening at the near bottom end of said cabinet, said horn having a mouth opening through said top end of said cabinet, the exterior walls of said horn and the interior wall of said cabinet defining an annular air chamber extending 360° around said horn exterior walls and substantially along the full length of said horn between said throat, and means mounting said horn in said cabinet to define said 360° annular air chamber; and a driver carried at the throat end of said horn such that the front of said driver projects therein for radiating compression waves therein, the back side of said driver projecting compression waves into said annular air chamber, said cabinet having a back wall with a port extending therethrough, said air chamber communicating the sound waves radiated from the rearward side of said driver to said port; a deflection panel carried at the top end of said cabinet adjacent the mouth of said horn such that sound waves emitted from the mouth of said horn are laterally deflected by said deflection panel for deflecting the sound from the front of said cabinet into the listening area, whereby the energy emitted in a rearward direction by said driver is communicated via said air chamber to said port to add said rearwardly emitted radiation of said driver to the radiation emitted from the front of said driver which is directed through said horn.

2. The speaker enclosure defined in claim 1 wherein said horn has a plurality of side walls, a selected number of which are tapered from said mouth to said throat.

* * * * *

UNITED STATES PATENT AND TRADEMARK OFFICE

CERTIFICATE OF CORRECTION

PATENT NO. : 4,033,431
DATED : July 5, 1977
INVENTOR(S) : James G. Ebejer

It is certified that error appears in the above-identified patent and that said Letters Patent are hereby corrected as shown below:

Column 1, lines 24 and 25, following "good" delete "tech-nniques" and insert --tech-niques--;

Column 2, line 64, preceding "in " delete "skillwd" and insert --skilled--;

Column 3, line 44, preceding "panel" delete "deflction" and insert --deflection--;

Column 3, line 47, before "panel" delete "deflction" and insert --deflection--;

Column 4, line 7, after the second occurrence of "horn" insert --24--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*